US009175940B1

(12) United States Patent
Collier

(10) Patent No.: US 9,175,940 B1
(45) Date of Patent: Nov. 3, 2015

(54) REVOLVED ARC PROFILE AXISYMMETRIC EXPLOSIVELY FORMED PROJECTILE SHAPED CHARGE

(71) Applicant: Innovative Defense, LLC, Smithville, TX (US)

(72) Inventor: Nicholas Collier, Smithvillle, TX (US)

(73) Assignee: Innovation Defense, LLC, Smithville, TX (US)

( * ) Notice: Subject to any disclaimer, the term of this patent is extended or adjusted under 35 U.S.C. 154(b) by 157 days.

(21) Appl. No.: 14/181,336

(22) Filed: Feb. 14, 2014

Related U.S. Application Data

(60) Provisional application No. 61/765,656, filed on Feb. 15, 2013.

(51) Int. Cl.
*F42B 10/00* (2006.01)
*F42B 12/02* (2006.01)
*F42B 33/00* (2006.01)

(52) U.S. Cl.
CPC ..... *F42B 12/02* (2013.01); *F42B 33/001* (2013.01)

(58) Field of Classification Search
CPC ..... F42B 1/028; F42B 1/032; F42B 1/036
USPC ..... 102/307
See application file for complete search history.

(56) References Cited

U.S. PATENT DOCUMENTS 2,757,611 A * 8/1956 Church ..... F42B 1/024 102/307
2,796,833 A * 6/1957 Sweetman ..... E21B 43/116 102/306
2,804,823 A 9/1957 Jablansky
3,302,567 A * 2/1967 Venghiattis ..... E21B 43/117 102/306
3,561,361 A 2/1971 Kessenich et al.
3,721,192 A 3/1973 McEwan et al.
3,838,644 A 10/1974 Prochnow et al.
3,903,803 A 9/1975 Losey
3,908,933 A 9/1975 Goss et al.
4,185,551 A * 1/1980 Drimmer ..... F42B 22/42 102/307
4,300,453 A 11/1981 Bigler
4,313,380 A 2/1982 Martner et al.
4,342,262 A 8/1982 Romer et al.
4,425,850 A 1/1984 Grossler
4,430,939 A 2/1984 Harrold
4,441,428 A 4/1984 Wilson
4,450,768 A 5/1984 Bell
4,466,353 A * 8/1984 Grace ..... F42B 1/02 102/307
4,551,287 A 11/1985 Bethmann (Continued)

FOREIGN PATENT DOCUMENTS

GB 2246621 5/1992

*Primary Examiner* — Samir Abdosh
(74) *Attorney, Agent, or Firm* — D. Scott Hemingway; Hemingway & Hansen, LLP

(57) ABSTRACT

This novel axisymmetric revolved arc explosively formed projectile (REFP) shaped charge design will produce a projectile that is greater than ⅔ the diameter of the device forms a hole larger than the device diameter and removes all of the target material within the hole diameter. The precision of the circular simultaneous initiation of the HE billet is accomplished by the use of a novel Circular Precision Initiation Coupler (CPIC). This CPIC uses a single point initiation to create a simultaneous peripheral detonation of the HE billet that collapses and drives the revolved liner into a large diameter double wall hollow cylindrical explosively formed projectile.

30 Claims, 2 Drawing Sheets

(56) References Cited

U.S. PATENT DOCUMENTS

| | | | | |
|---|---|---|---|---|
| 4,632,036 | A | 12/1986 | Ringel | |
| 4,643,097 | A | 2/1987 | Chawla et al. | |
| 4,665,826 | A | 5/1987 | Marer | |
| 4,669,386 | A | 6/1987 | Precoul et al. | |
| 4,672,896 | A | 6/1987 | Precoul et al. | |
| 4,688,486 | A | 8/1987 | Hall et al. | |
| 4,759,886 | A | 7/1988 | Daugherity | |
| 4,833,994 | A | 5/1989 | Strobush | |
| 4,841,864 | A | 6/1989 | Grace | |
| 4,896,609 | A | 1/1990 | Betts et al. | |
| 4,982,665 | A | 1/1991 | Sewell et al. | |
| 4,989,517 | A | 2/1991 | Adimari et al. | |
| 5,003,884 | A | 4/1991 | Nissl et al. | |
| 5,078,069 | A | 1/1992 | August et al. | |
| 5,088,416 | A | 2/1992 | Sabranski | |
| 5,235,128 | A | 8/1993 | Hardesty et al. | |
| 5,245,927 | A | 9/1993 | Ranes | |
| 5,251,561 | A | 10/1993 | Murphy | |
| 5,269,223 | A | 12/1993 | Mattsson et al. | |
| 5,320,044 | A | 6/1994 | Walters | |
| 5,621,185 | A | 4/1997 | Spengler et al. | |
| 5,753,850 | A * | 5/1998 | Chawla | F42B 1/02 102/307 |
| 5,847,312 | A | 12/1998 | Walters et al. | |
| 5,988,071 | A | 11/1999 | Taylor | |
| 6,179,944 | B1 | 1/2001 | Monolo et al. | |
| 6,354,219 | B1 | 3/2002 | Pratt et al. | |
| 6,443,068 | B1 | 9/2002 | Meister | |
| 6,477,959 | B1 | 11/2002 | Ritman et al. | |
| 6,644,205 | B2 | 11/2003 | Ritman et al. | |
| 6,668,726 | B2 | 12/2003 | Lussier | |
| 6,758,143 | B2 | 7/2004 | Ritman et al. | |
| 6,792,866 | B2 | 9/2004 | Grattan | |
| 6,840,178 | B2 | 1/2005 | Collins et al. | |
| 7,261,036 | B2 | 8/2007 | Bourne et al. | |
| 7,621,221 | B2 | 11/2009 | Ritman | |
| 7,753,850 | B2 | 7/2010 | Averkiou et al. | |
| 7,779,760 | B2 | 8/2010 | Konig | |
| 7,810,431 | B2 | 10/2010 | Heine et al. | |
| 7,819,064 | B2 | 10/2010 | Saenger et al. | |
| 8,375,859 | B2 | 2/2013 | Sagebiel | |
| 2003/0183113 | A1 * | 10/2003 | Barlow | F42B 1/028 102/476 |
| 2005/0188878 | A1 | 9/2005 | Baker et al. | |
| 2006/0107862 | A1 | 5/2006 | Davis et al. | |
| 2008/0011179 | A1 | 1/2008 | Michel et al. | |
| 2008/0134925 | A1 | 6/2008 | Konig | |
| 2008/0289529 | A1 | 11/2008 | Schilling | |
| 2009/0211481 | A1 | 8/2009 | Schwantes et al. | |
| 2011/0232519 | A1 | 9/2011 | Sagebiel | |
| 2013/0199394 | A1 | 8/2013 | Collier | |

* cited by examiner

REVOLVED ARC PROFILE AXISYMMETRIC EXPLOSIVELY FORMED PROJECTILE SHAPED CHARGE

RELATED APPLICATION DATA

This application is a non-provisional application which claims the benefit of U.S. Provisional Application No. 61/765,656, filed Feb. 15, 2013.

TECHNICAL FIELD OF INVENTION

This invention relates to shaped charges and in particular to a revolved arc profile shaped explosive device that produces a full caliber or greater hole, that is to say a hole as large as the explosive charge diameter (CD).

BACKGROUND OF THE INVENTION

Shaped charges come in many sizes and shapes and are used mainly for military weaponry and oil well perforating; to a lesser extent demolition and rescue are also users of this complex technology.

The term shaped charge literally refers to a quantity of explosive that is shaped in some way to focus its energy. Shaped charge is also more loosely used to mean a shaped quantity of high explosive with a metal or other liner, a containment body and a means of detonation.

The concept of shaping an explosive charge, in order to focus its energy was known in 1792. ("The History of Shaped Charges" Donald R Kennedy)

In the 1930's Misznay and Chardin, Hungarian and German physicists, created a shaped explosive device that forms a shuttlecock like projectile that can be tailored to very long standoff. This type of device is commonly known as a Misznay Chardin device, a Self Forging Frag or an Explosively formed Projectile (EFP). They discovered that when a disc of explosive with a concavity on one side is detonated correctly it will focus its energy perpendicular to the plane of the disc in both directions, and if the cavity in the explosive disc was lined with a ductile metal it would be formed into a high speed projectile. This dished liner for this device resembled a shallow dished platter much like a tea saucer. Because of the shallowness of the concavity of the liner and the flatness of the detonation wave attacking it, ninety percent of the liner mass is folded into an EFP, unlike a Munroe effect shaped charge whose jet is only approximately 20% of the liner mass.

Although EFP devices qualify as shaped charges in the common vernacular, they operate on a different principle than a Munroe shaped charge. EFP devices have lower projectile velocities, greater projectile mass, penetrate less deep but make larger holes than a Munroe effect shaped charge yet not super caliber holes.

Conventional EFP producing charges have been used in antitank and other directed energy weapons for many years and have been refined in an effort to make a high speed primary jet for missile seeker removal, but will not produce a hole in an infinite target large enough to place another device of the same size at the bottom of that hole.

Throughout the history of shaped charges the primary effort of research in this field was directed toward depth of penetration by the jet. Although hole size is worth considering, little research has been done on significantly increasing jet diameter and cross-sectional shape of the jet to produce a larger hole diameter. In oil field applications a larger hole is most desirable as the flow area of the hole increases rapidly with an increase in hole diameter. With the ability to produce a full caliber hole, a follow on or follow through device can be deployed into the hole to the correct standoff from the bottom of the hole. When detonated at the correct standoff this will increase the hole depth by that of the primary hole producing device, this can be repeated numerous times in the same hole.

SUMMARY OF INVENTION

This novel axisymmetric REFP shaped explosive device differs from a conventional lined EFP in that the REFP device produces a large diameter double wall hollow cylindrical projectile as opposed to a small diameter shuttle cock like projectile from a conventional platter charge or Misznay Chardin plate.

The REFP designs will efficiently remove more target material than the same size standard Misznay Chardin device. This is accomplished by the larger diameter projectile produced by the REFP device which will form a hole larger in diameter than the device diameter and removes the full device diameter of target material. To produce a significantly larger diameter projectile one must consider focusing the energy of the driven liner in a much larger pattern than that of a conventional EFP device. The projectile of the REFP device being greater than ⅔ the diameter of the device forms a hole larger than the device diameter and removes all of the target material within the hole diameter. The projectile from the axisymmetric REFP lined shaped explosive device will produce a full or super caliber hole (i.e., larger the explosive device or explosive charge diameter (CD) in a target. The capability of the REFP device to produce a super caliber hole allows follow on devices of the same caliber to theoretically produce the hole to infinite depths. The REFP device consists of a liner, HE billet, a body, inner body, Initiation system and shock attenuation components.

The precision of the circular simultaneous initiation of the HE billet is accomplished by the use of a novel Circular Precision Initiation Coupler (CPIC). The CPIC initiation system is a single point to ring or peripheral initiation and is mated to the aft end of the HE billet and centered by the outer body so as to align the CPIC output with the pole axis of the liner. As the detonation wave reaches the intersection of the collapse axis and pole of the liner the enormous detonation pressures cause the pole material of the liner to accelerate forward and the inner and outer walls to elongate along the collapse axis forming the walls of the stretching hollow cylindrical projectile. This CPIC uses a single point initiation to create a simultaneous peripheral detonation of the HE billet that collapses and drives the REFP liner into a high speed stretching hollow cylindrical projectile, or more commonly called a jet in the industry. The CPIC can be used with many swept liner geometries, and tailored to the desired size and shape required.

BRIEF DESCRIPTION OF THE DRAWINGS

Because of the complexity of shapes involved, the inventor will use descriptive drawings and text to describe the device and how it functions.

DETAILED DESCRIPTION

Figure 1:
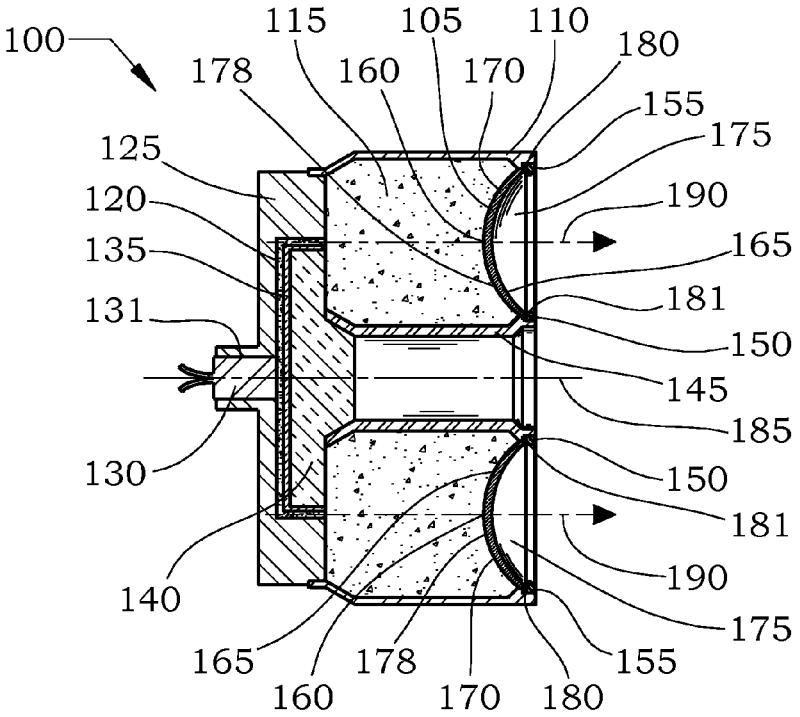
FIG. 1 is a cross-sectional view of a forward facing revolved arc profile explosively formed projectile (REFPff) shape charge device.

This invention relates to shaped explosive devices and in particular to a novel swept or revolved arc profile liner, of desired material, interfaced to a hollow cylinder of appropriately shaped high explosive (HE), having provisions for a precision initiation train, HE containment, and tamping of HE if desired. Typical lined explosively formed projectile (EFP) produce a small diameter shuttle cock like projectile from a conventional platter charge or Misznay Chardin plate. The RAP liner in this device, when driven by the precision detonation of the HE billet, forms a large diameter double wall hollow cylindrical EFP. Two possible embodiments of the revolved arc profile EFP (REFP) invention are the forward folding REFP (REFPff) and the rearward folding REFP (REFPrf). The profile of a rearward folding REFP liner is a shallow concavity having a polar axis an inner and outer diameter and is tailored thin at the pole and thickening toward the inner and outer diameters. A forward folding REFP liner profile is thin at the mounting edges and thickening toward the pole. The diameter of the EFP formed from either the REFPrf or REFPff liner is greater than ⅔ the diameter of the device and will produce a hole greater than the overall diameter of the device, also known as super caliber hole.

This novel REFP device differs from a conventional EFP device in that the REFP device produces a large diameter hollow projectile as opposed to common small diameter projectile from a conventional platter lined EFP charge. The uses and advantages of this innovation in REFP design are many in both military and commercial applications. This jet from the REFP device will produce a full or super caliber hole in a target, that is to say a hole as large as the explosive charge diameter (CD). The capability of the REFP device to produce a super caliber hole allows follow on devices of the same caliber to theoretically produce the hole to infinite depths.

The uses and advantages of this innovation in shaped charge design are many in both military and commercial applications.

The REFP designs will efficiently remove more target material than the same size standard Misznay Chardin device. This is accomplished by the larger diameter projectile produced by the REFP device which will form a hole larger in diameter than the device diameter and removes the full device diameter of target material. To produce a significantly larger diameter projectile one must consider focusing the energy of the driven liner in a much larger pattern than that of a conventional EFP device. The projectile of the REFP device being greater than ⅔ the diameter of the device forms a hole larger than the device diameter and removes all of the target material within the hole diameter. The projectile from the axisymmetric REFP lined shaped explosive device will produce a full or super caliber hole (i.e., larger the explosive device or explosive charge diameter (CD)) in a target. The capability of the REFP device to produce a super caliber hole allows follow on devices of the same caliber to theoretically produce the hole to infinite depths. The REFP device consists of a liner, HE billet, a body, inner body, Initiation system and shock attenuation components.

The revolved profile REFP liner for this application looks like a length of thin walled tubing formed into a circle and cut parallel to the equatorial plane at less than a full diameter, forming a thin wall trough with a wall thickness between inner and outer arced surfaces. The REFP liner could also be described as a washer, having a shallow concavity with an inner and outer surface, forming concave and convex surfaces. The depth of the trough concavity is shallow and carefully controlled in thickness profile between the inner and outer surfaces, providing for the desired stretch during the formation of the large diameter hollow cylindrical projectile. The inner and outer arcs of the REFP liner surfaces can be concentric to each other or offset from one another, non-concentric arcs can help compensate for an unbalanced stretch rate of the projectile and help balance the detonation gas pressure retention on the inner wall due to space restrictions. Circular is not the only shape possible with this revolved arc profile.

The revolved arc segments of the REFP liner profile form an inner concave and outer convex surface with a thickness profile between these surfaces. The convex surface of the liner is interfaced to a concave circular depression in the fore end of the wall of the hollow cylinder of the HE billet, the HE billet having inner and outer diameters similar to the liner diameters. When the HE billet is initiated, a detonation wave travels through the HE from rear to front of the device releasing its energy and driving the REFP liner. As the detonation wave reaches the pole axis of the REFP liner it causes the pole material of the liner to accelerate forward and the inner and outer walls to elongate parallel to the collapse axis, forming the double wall of the hollow shuttlecock like projectile. When the HE billet is detonated on the aft end in a simultaneous ring, which is aligned with the liner pole axis, the ring detonation wave folds the liner, pole first for a REFPrf and pole last for a REFPff, into a double wall hollow cylindrical projectile of more than ⅔ the diameter of the REFP device.

To simplify the description of the geometry, detonation and collapse of a REFP liner we could look at the two dimensional (2D) profile of the swept liner shape and other device components as if the charge was cut sagittal through the axis of symmetry. This cut will show the liner profile that makes the hollow toroid with an inner and outer wall joined at the pole or collapse axis of the curvature. The collapse axis that passes through the pole of swept liner is visually an axis when viewing it in a 2D profile, but in reality it is not a true axis. If viewed in three dimensional (3D) space this collapse axis would be seen as a hollow cylinder with a diameter equal to the pole diameter of the liner extending through the length of the device and coaxial to the device axis of symmetry. For ease of discussion the 2D term collapse axis will be used to describe the 3D hollow cylinder that the liner collapses on.

The HE Billet in its most basic form is a right circular cylinder having a through hole at its center leaving a wall thickness similar to the width between the inside and outside diameters of the REFP liner. The billet is of sufficient length to provide adequate head height of HE above the REFP liner surface so there is sufficient HE to drive the REFP liner in the desired fashion. The wall of the HE billet has a concentric swept concavity at its front end matching the outside convex surface of the REFP liner, in size and contour. The REFP liner is inserted snugly into the concavity of the HE billet, making a liner HE sub assembly of the device. The REFP device can use cast, pressed, extruded or even hand packed HE from any high quality explosive. When the HE billet is initiated a detonation wave travels through the HE from rear to front of the device releasing its energy and driving the REFP liner. As the detonation wave reaches the pole axis of the REFP liner it causes the pole material of the liner to accelerate forward and the inner and outer walls to elongate parallel to the collapse axis, forming the double wall of the hollow shuttlecock like projectile.

To initiate a swept profile shaped charge the HE billet detonation should be initiated by a simultaneous ring detonation from a Circular Precision Initiation Coupler (CPIC). The CPIC initiates detonation of the HE billet in a circular pattern at the aft end of the HE billet at the exact diameter of the pole of the swept liner profile and at a sufficient head height above the liner surface. Head height determines the detonation wave radius that intersects the liner at its pole. The combination of the flatness of the detonation wave and the depth of the liner's concavity determine the stretch of the projectile. The precision of the circular simultaneous initiation of the HE billet is accomplished by the use of a novel Circular Precision Initiation Coupler (CPIC). The CPIC initiation system is a single point to ring or peripheral initiation and is mated to the aft end of the HE billet and centered by the outer body so as to align the CPIC output with the pole axis of the liner. As the detonation wave reaches the intersection of the collapse axis and pole of the liner the enormous detonation pressures cause the pole material of the liner to accelerate forward and the inner and outer walls to elongate along the collapse axis forming the walls of the stretching hollow cylindrical projectile. This CPIC uses a single point initiation to create a simultaneous peripheral detonation of the HE billet that collapses and drives the REFP liner into a high speed stretching hollow cylindrical projectile, or more commonly called a jet in the industry. The CPIC can be used with many swept liner geometries, and tailored to the desired size and shape required.

Detonation shock wave control is very important to form stable jetting from shaped charges. Reflected shock waves can negatively affect jet formation and the overall performance of the shape charge. The REFP design in this embodiment has various features incorporating irregular shaped solids, in the center through hole, made from low sound speed material such as high density foam and powdered metals and combinations thereof. Since the smaller oil well devices of this REFP device design offers little room in the center hole in the HE billet measures must be taken to break up, absorb and attenuate the shock from the HE detonation in this region for sufficient time for the jet to form.

In order to take advantage of the penetrating power of a shaped charge to produce a full caliber hole, it is necessary to concentrate the energy of the jetting material in a different pattern than that of a conventional shaped charge, such as spreading the energy into a large diameter circle, thus the need for a revolved double arc segment profile design. Technical definitions for these shapes are difficult to create, in this interest an explanation of segment is in order.

A segment of a circle is the area bounded by the arc and a chord, the chord being less than a full circles diameter. In the case of the revolved profile liner, there must be two arcs and we are only concerned with the area between these arcs, which forms the thickness profile that is revolved about the axis of symmetry forming a shallow concave trough with an inside and outside diameter.

This shallow profile circular trough has a pole axis which divides the REFP liner into an outside wall and inside wall, the inside wall having less mass than the outside wall for the same thickness due to smaller diameter and less volume. The mass difference must be compensated for to produce a stable projectile, this will be accomplished through experiment and computer code calculations.

The HE billet inner and outer thickness and mass will also need to be compensated for because of the volume changes due to diameter. This inner and outer HE to liner mass balance will be done by tailoring the inner and outer HE billet thickness to provide the right impulse to the liner walls on both sides of the pole or collapse axis.

To produce a straight axisymmetric hollow cylindrical jet about the symmetrical axis of the REFP device it is necessary to balance the explosive gas pressures and the wall thickness on either side of the pole or collapse axis of the REFP liner. The inner and outer walls separated by the collapse axis have different masses due to diameter differences and longer duration pressures in the center due to space restrictions especially in smaller diameters.

Although the REFP charge will not penetrate as deep as a conventional shaped charge it will remove a full charge diameter of material, which allows the REFP to remove far more material volume than a much deeper penetrating conventional shaped charge device. Since REFP devices produce, full caliber holes it is possible to send follow on charges into the penetration deepening the hole and sending the debris out of the hole at high velocity. Follow on charges are not possible with traditional shaped charges or Misznay Chardin devices since the penetration hole is very much smaller than the charge diameter which prevents the next charge from obtaining the correct standoff from the bottom of the hole. Oil and gas well completions and military users will benefit greatly from the use of REFP devices which is the goal of this shaped charge concept and development.

Herein disclosed is an explosively formed projectile shaped charge device. The shaped charge device has a liner configured in a partial toroid with a longitudinal axis intersecting an aperture located near the center of the partial toroid. The partial toroid being open-ended on a plane that intersects the longitudinal axis in a perpendicular manner toward a front end of the shaped charge device. The liner having a hollow arc cross-section extending toward a closed end of the partial toroid as defined by a longitudinal plane that is aligned on the longitudinal axis and a pole of the arc cross-section at a closed end of the partial toroid that extends toward a rear end of the shaped charge device. The liner having an outer surface and an inner surface, the inner surface exposed toward the open end of the front end of the shaped charge device. The liner having a first thickness proximate the open end of the partial toroid and a second thickness proximate the pole at the closed end of the partial toroid. The liner produces a pole trailing or leading explosive large diameter double wall hollow cylindrical explosively formed projectile directed toward the front of the shaped charge device upon detonation of the shaped charge device.

A billet of high explosive material having a front end and a rear end located behind and proximate to the outer surface of the liner and configured as a toroid with an internal aperture located proximate to the aperture of the liner. The billet producing a high explosive detonation effect applied to the liner to produce the large diameter double wall hollow cylindrical explosively formed projectile. A coupler located in a rear portion of the shaped charge device and coupled to the rear end of the billet and the coupler producing a detonation wave initiating the high explosive detonation effect of the billet; and A body located around the outer surface of the billet and extending longitudinally the length of the billet. The body having a front end secured to the liner and, the body having a rear end secured to the coupler. An attenuator located proximate to the aperture in the billet that dampens a detonation wave. A center body located proximate to the aperture of the liner and rearward of the billet toward the rear portion of the shaped charge device.

Herein disclosed is a method of producing a double wall hollow cylindrical explosively formed projectile from a shaped charge device by providing a liner configured in a partial toroid with a longitudinal axis intersecting an aperture located near the center of the partial toroid. The partial toroid being open-ended on a plane that intersects the longitudinal axis in a perpendicular manner toward a front end of the shaped charge device. The liner having a hollow hemispherical cross-section extending toward a closed end of the partial toroid as defined by a longitudinal plane that is aligned on the longitudinal axis and a pole of the hemispherical cross-section at a closed end of the partial toroid that extends toward a rear end of the shaped charge device. The liner having an outer surface and an inner surface, the inner surface exposed toward the open end of the front end of the shaped charge device. The liner having a first thickness proximate the open end of the partial toroid and a second thickness proximate the pole at the closed end of the partial toroid. The liner producing a pole leading or trailing explosive large diameter double wall hollow cylindrical explosively formed projectile directed toward the front of the shaped charge device upon detonation of the shaped charge device.

Positioning a billet of high explosive material behind and proximate to the outer surface of the liner and proximate to the aperture of the liner, and the billet producing a high explosive detonation effect applied to the liner. Positioning a coupler at a rear portion of the shaped charge device in contact with the rear of the billet. The coupler producing a detonation wave and initiating the high explosive detonation effect of the billet.

Surrounding the shaped charge device with a body around the outer diameter of the billet and extending longitudinally the length of the billet. Producing a large diameter double wall hollow cylindrical explosively formed projectile with the liner that is directed toward the front of the shaped charge device upon detonation of the shaped charge device.

Additionally you can provide an attenuator proximate to the aperture in the billet that dampens a detonation wave and position a center body proximate to the aperture of the liner and rearward of the billet toward the rear portion of the shaped charge device.

The revolved arc profile explosively formed projectile forward folding (REFPff) device 100 shown in FIG. 1 consists of a REFPff liner 105, body 110, HE billet 115 which is a mass of high explosive, a Circular Precision Initiation Coupler (CPIC), an explosive shock attenuator (ESA) 140, a center body 145, an inner retaining ring 150, and an outer retaining ring 155. All components of REFPff 100 share a common symmetrical axis 185.

The REFPff liner 105, located about the fore area of the REFPff, is the working material of the shaped charge and will be optimized in thickness, profile and material to produce the desired effects on the target material. Preferably the liner uses a copper material, but liners may be made from most any metal, ceramic, powdered metals, tungsten, silver, copper or a combination thereof.

Figure 1A:
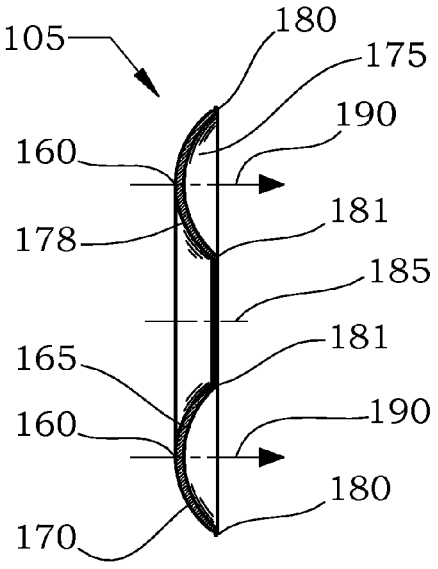
FIG. 1A is a cross-sectional view of a REFPff liner.

The REFPff liner 105, as singularly shown in FIG. 1A, has an inside wall 165, an outside wall 170, a pole 160 an outer base end 180, an inner base end 181, an outer arc surface 178 that faces away from collapse axis 190, and an inner arc surface 175 that faces toward collapse axis 190. Outer arc surface 178 and inner arc surface 175 can be concentric to each other or offset centers to tailor the thickness of the inside wall 165 and outside wall 170. Stable jetting can be achieved if the REFPff liner 105 wall mass on either side of the pole 160 at the collapse axis 190 is balanced correctly. The mass of the REFPff liner 105 will increase greatly from the inside diameter (ID) closest to the symmetrical axis 185 to the outside diameter (OD) because of the large volume increase as the diameter of the liner wall increases from the ID to the OD. The mass difference must be compensated for to balance the momentum of the collapse and stretching of the REFPff liner 105 walls and produce a stable projectile. This may be accomplished through experiment, computer code calculations, or calculations by other means.

The profile of a REFPff liner profile is thin at the mounting edges and thickening toward the pole. The diameter of the EFP formed from the REFPff liner is greater than ⅔ the diameter of the device and will produce a hole greater than the overall diameter of the device, also known as super caliber hole.

Outer arc surface 178 and inner arc surface 175 can be concentric to each other or have offset centers to tailor the thickness of the inside wall 165 and outside wall 170, stable jetting can be achieved if the REFPff liner 105 wall mass on either side of the pole 160 at the collapse axis 190 is balanced correctly. The mass of a constant wall thickness liner will increase greatly from the inside diameter (ID) closest to the symmetrical axis 185 to the outside diameter (OD) because of the large volume increase as the diameter of the liner wall increases from the ID to the OD. This can be solved by offsetting the centers of outer arc surface 178 to inner arc surface 175 making the inside wall 165 thicker than the outside wall 170 to achieve equal liner wall mass above and below the collapse axis 190.

Offset arc centers will make the thickness of inside wall 165 gradually decrease from the pole 160 to the inner base end 181, and the thickness of outside wall 170 gradually decreases from pole 160 to the outer base end 180. The wall thickness is varied in this way to balance the explosive charge to REFPff liner 105 mass ratios, which also balances the momentum of the collapse and stretching of the REFPff liner 105 walls. Liner wall momentum balancing will insure that inside wall 165 and outside wall 170 will stretch to approximately the same length forming and maintaining a stable EFP. Balancing the liner wall momentums should not be held only to the offset method previously described. Other thickness profiles of the liner can be utilized to balance liner wall momentums, i.e., multiple arcs making both the inside wall 165 and outside wall 170 could also be used to accomplish the desired profile thickness that will produce the best projectile performance.

For example, with a 5 inch diameter liner of offset arc centers, the inside wall 165 needs to be between 1-3 mm at the pole 160 and taper toward the inner base end 181 to between 2-5 mm. The outside wall 170 must taper the reverse direction from between 1.5-3 mm at the pole 160 and tapering down to between 1-2.5 mm at the outer base end 180. These dimensions will be refined with numerical code and experiment to give the most tailored jet to address the specific target material. Jet velocities can vary from 4 to 10 km/s depending on the liner material, wall thickness and other geometries. Other thickness profiles of the liner can be utilized to balance liner wall momentums (i.e., making both the inside wall 165 and outside wall 170 into multiple arcs to accomplish the desired profile thickness that will produce the best projectile performance).

The HE billet 115 provides the energy to collapse the REFPff liner 105, causing it to form a hollow double wall forward folded shuttlecock like projectile commonly called an explosively formed projectile EFP. The body 110 provides an outer mounting surface for REFPff liner 105 which is held to body 110 by outer retaining ring 155. Body 110 also serves as a containment vessel to protect and hold the shape of the delicate HE billet 115 from damage or impact. Body 110 can provide tamping for HE billet 115 depending on body 110 thickness and material density.

The HE billet 115 in its most basic form is a right circular cylinder having a through hole at its center leaving a wall thickness, or distance from the inside diameter to the outside diameter of the HE billet, greater than the annulus width (AW) between the inside and outside diameters of the liner. The HE billet 115 is of sufficient length to provide adequate head height of HE aft of the liner outer semicircle surface 178 so there is sufficient HE to drive the liner 105 in the desired fashion. The fore end of the HE billet 115 has a concentric swept concavity matching the outer semicircle surface 178 of the liner, which is a convex surface, in size and contour. The thickness of the HE billet 115 being larger than the AW provides for super caliber explosive all the way to the equator of the half torus or circular hollow trough. This makes for higher jet velocities, more jet mass, longer jet and better penetration performance. The liner 105 is inserted snugly into the concavity of the HE billet 115, making a liner/HE sub-assembly of the device. The REFPrf device can use cast, pressed, extruded or even hand packed HE from any high quality explosive.

The wall thickness of the HE billet 115 can range from about 0-25% larger than the AW of the REFPrf liner 105 and still produce a proper jet. If the wall thickness of the liner and the amount of HE used are not correctly matched for the application it will result in an under driven or over driven liner, neither event will produce proper jetting. Adequate charge to mass ratios of HE to liner as per Gurney equations should be adhered to as close as the application size restrictions will allow to prevent underdriving or overdriving the liner.

The CPIC initiates detonation of the HE billet 115 in a circular pattern at the aft end and at the exact diameter of the pole of the REFPff liner 105. The CPIC, located in the aft area of the REFPff, consists of a CPIC HE 120, charge cover 125, detonator 130, and CPIC HE cover 135. Detonator 130, located about the aft of the CPIC, provides the initial detonation impulse to the shallow cup shaped CPIC HE 120. Charge cover 125 provides a mounting cavity 131 for detonator 130 and CPIC HE 120, and provides the critical alignment of detonator 130 with CPIC HE 120 on the symmetrical axis 185. Charge cover 125 also provides the critical alignment of CPIC HE 120 with HE billet 115, this alignment allows for a precise ring initiation of HE billet 115. Charge cover 125 also serves to cover and protect HE billet 115 and maintains intimate contact of CPIC HE 120 with the HE billet 115. The CPIC function is to transform a single point initiation from detonator 130 into a ring detonation of the CPIC HE 120 that will ring initiate the aft end of the HE billet 115 which is precisely aligned with the collapse axis 190 and pole of REFPff liner 105.

To initiate a revolved profile EFP device the HE billet 115 detonation must be initiated by a simultaneous ring detonation from a Circular Precision Initiation Coupler (CPIC). The precision of the circular simultaneous initiation of the HE billet 115 is accomplished by the use of a novel Circular Precision Initiation Coupler (CPIC). The CPIC initiation system is a single point to ring or peripheral initiation and is mated to the aft end of the HE billet 115 and centered by the outer body 110 so as to align the CPIC output with the pole axis of the liner 105. As the detonation wave reaches the intersection of the collapse axis 190 and pole 160 of the liner 105, the enormous detonation pressures cause the pole material of the liner 105 to accelerate forward and the inner 165 and outer 170 walls to elongate along the collapse axis 190 forming the walls of the stretching hollow cylindrical jet. This CPIC uses a single point initiation to create a simultaneous peripheral detonation of the HE billet 115 that collapses and drives the REFPff liner 105 into a high speed stretching hollow cylindrical projectile, or more commonly called a jet in the industry. The CPIC can be used with many swept liner geometries, and tailored to the desired size and shape required.

The REFPff liner 105 looks like a length of thin walled tubing formed into a circle and cut parallel to the equatorial plane at less than a full diameter, forming a thin wall trough with a wall thickness between inner arc surface 175 and outer arc surface 178. The REFPff liner 105 could also be described as a washer, having a shallow concavity with an inner and outer surface, forming concave and convex surfaces. The depth of the trough concavity is shallow and carefully controlled in thickness profile between the inner arc surface 175 and outer arc surface 178, providing for the desired stretch during the formation of the large diameter hollow cylindrical projectile. The inner arc surface 175 and outer arc surface 178 of the REFPff liner 105 can be concentric to each other or offset from one another, non-concentric arcs can help compensate for an unbalanced stretch rate of the projectile and help balance the detonation gas pressure retention on the inner wall due to space restrictions. Circular is not the only shape possible with this revolved arc profile.

The revolved arc segments of the REFPff liner 105 profile forms an inner concave arc and outer convex arc surface with a thickness profile between these surfaces. The convex surface of the liner is interfaced to a concave circular depression in the fore end of the HE billet, the HE billet having inner and outer diameters similar to the liner diameters. When the HE billet is initiated, a detonation wave travels through the HE from rear to front of the device releasing its energy and driving the REFP liner. As the detonation wave reaches the pole axis of the REFP liner it causes the pole material of the liner to accelerate forward and the inner and outer walls to elongate parallel to the collapse axis, forming the double wall of the hollow shuttlecock like projectile. When the HE billet is detonated on the aft end in a simultaneous ring, which is aligned with the liner pole axis, the ring detonation wave folds the liner, pole last for a REFPff, into a double wall hollow cylindrical projectile of more than ⅔ the diameter of the device.

The jetting trajectory of this REFPff liner 105 can be aimed other than parallel to the symmetrical axis of the device just by a changing the angle of attack of the detonation wave relative to the pole axis of the liner 105. This is done by changing the diameter and angle of the CPIC initiation of the HE billet 115 so the detonation front engages the liner outer semicircle surface 178 at either a larger or smaller diameter than the collapse axis 190 and tangentially to the liner curvature.

To produce a straight EFP jet about the symmetrical axis 185 of the REFPff device, it is necessary to balance the explosive gas pressures and the inner 165 and outer 170 liner wall masses. The liner wall masses can be balanced by adjusting the wall thickness on either side of the pole 160 at the collapse axis 190 of the liner 105, these liner wall masses differ due to large volume increase as the diameter of the liner wall increases. The HE mass also increases greatly with a diameter increase and needs to be balance correctly to the given liner mass. Adequate charge to mass ratios of explosive to liner as per Gurney equations should be adhered to as close as the application size restrictions will allow to prevent underdriving or overdriving the liner. The ideal charge to mass ratio can be tricky to obtain for a REFPff liner device especially as the device becomes smaller (i.e., a 5 inch REFPff liner device has more space or volume between the symmetrical axis and the collapse axis for HE mass balancing than a 2 inch REFPff).

The ESA 140 is a shock attenuator made from a low sound velocity material and serves as a detonation wave dampener. Center body 145 supports the inner diameter of HE billet 115, provides space for ESA 140, a path for escaping detonation gases, and other devices (i.e., secondary projectile forming devices). Center body 145 provides an inner mounting surface for REFPff liner 105 and aligns it with symmetrical axis 185. REFPff liner 105 is held to center body 145 by inner retaining ring 150. REFPff device 100 is capable of producing a double wall forward folded shuttlecock like projectile from the REFPff liner 105 that will produce a full caliber hole in the target.

The center body 145 is encompassed by the explosive charge or main high explosive (HE) billet and can be solid or hollow. The hollow center body 145, being an essential part of the revolved design, could contain shock attenuation materials used to dampen, reflect, and absorb shock waves that would have a detrimental effect on the formation of a stable jet. The hollow center body 145 space can also be used to contain a center projectile producing device or for adjusting HE billet quantity driving the inside wall of the liner, in addition the space can be used to relieve pressure from expanding gasses from the detonation of the HE.

Detonation shock wave control is very important to form stable jetting from shaped charges. Reflected shock waves can negatively affect jet formation and the overall performance of the shape charge. The REFPff liner 105 design in this embodiment has various features incorporating irregular shaped solids, in the hollow center body 145. These shaped solids can be made from low sound speed material such as high density foam, powdered metals and combinations thereof. Since the smaller REFPff devices offer little room in the center body 145, measures must be taken to break up, absorb and attenuate the shock from HE detonation in this region for sufficient time for the jet to form.

In order to take advantage of the penetrating power of a shaped charge to produce a full caliber hole, it is necessary to concentrate the energy of the jetting material in a different pattern than that of a conventional shaped charge, such as spreading the energy into a large diameter circle, thus the need for a revolved double arc segment profile design. Technical definitions for these shapes are difficult to create, in this interest an explanation of segment is in order.

A segment of a circle is the area bounded by the arc and a chord, the chord being less than a full circles diameter. In the case of the revolved profile liner, there must be two arcs and we are only concerned with the area between these arcs, which forms the thickness profile that is revolved about the axis of symmetry forming a shallow concave trough with an inside and outside diameter.

This shallow profile circular trough has a pole axis which divides the REFPff liner into an outside wall and inside wall, the inside wall having less mass than the outside wall for the same thickness due to smaller diameter and less volume. The mass difference must be compensated for to produce a stable projectile, this will be accomplished through experiment and computer code calculations.

The HE billet inner and outer thickness and mass will also need to be compensated for because of the volume changes due to diameter. This inner and outer HE to liner mass balance will be done by tailoring the inner and outer HE billet thickness to provide the right impulse to the liner walls on both sides of the pole or collapse axis.

To produce a straight axisymmetric hollow cylindrical jet about the symmetrical axis of the REFP device it is necessary to balance the explosive gas pressures and the wall thickness on either side of the pole or collapse axis of the REFPff liner. The inner and outer walls separated by the collapse axis have different masses due to diameter differences and longer duration pressures in the center due to space restrictions especially in smaller diameters.

FIG. 1A shows the REFPff liner 105 that is used in device 100 of FIG. 1. The REFPff liner 105 consist of a outer base end 180, inside wall 165, pole 160, inner base end 181, outside wall 170, axis of symmetry 185, collapse axis 190, an inner arc surface 175 and outer arc surface 178. Collapse axis 190 is shown parallel to the axis of symmetry 185, but can be almost any angle relative to the axis of symmetry 185 that would represent a converging or diverging projectile trajectory formed by the detonation wave and forward folding REFP liner. The REFPff liner 105 is a thin walled arc profile, swept or revolved about a central symmetrical axis 185. The swept profile having an inside and outside diameter, a radius depth to inner arc surface 175 and outer arc surface 178 along the collapse axis 190, and when revolved about its symmetrical axis 185 it forms a hollow circular trough with an arced concavity between the inner and outer diameters. There is a wall thickness to this trough that is proportional to the outside diameter minus the inside diameter of the liner.

Outer arc surface 178 and inner arc surface 175 can be concentric to each other or have offset centers to tailor the thickness of the inside wall 165 and outside wall 170, stable jetting can be achieved if the REFPff liner 105 wall mass on either side of the pole 160 at the collapse axis 190 is balanced correctly. The mass of a constant wall thickness liner will increase greatly from the inside diameter (ID) closest to the symmetrical axis 185 to the outside diameter (OD) because of the large volume increase as the diameter of the liner wall increases from the ID to the OD. This can be solved by offsetting the centers of outer arc surface 178 to inner arc surface 175 making the inside wall 165 thicker than the outside wall 170 to achieve equal liner wall mass above and below the collapse axis 190.

Offset arc centers will make the thickness of inside wall 165 gradually decrease from the pole 160 to the inner base end 181, and the thickness of outside wall 170 gradually decreases from pole 160 to the outer base end 180. The wall thickness is varied in this way to balance the explosive charge to REFPff liner 105 mass ratios, which also balances the momentum of the collapse and stretching of the REFPff liner 105 walls. Liner wall momentum balancing will insure that inside wall 165 and outside wall 170 will stretch to approximately the same length forming and maintaining a stable EFP. Balancing the liner wall momentums should not be held only to the offset method previously described. Other thickness profiles of the liner can be utilized to balance liner wall momentums, i.e., multiple arcs making both the inside wall 165 and outside wall 170 could also be used to accomplish the desired profile thickness that will produce the best projectile performance.

Figure 1B:
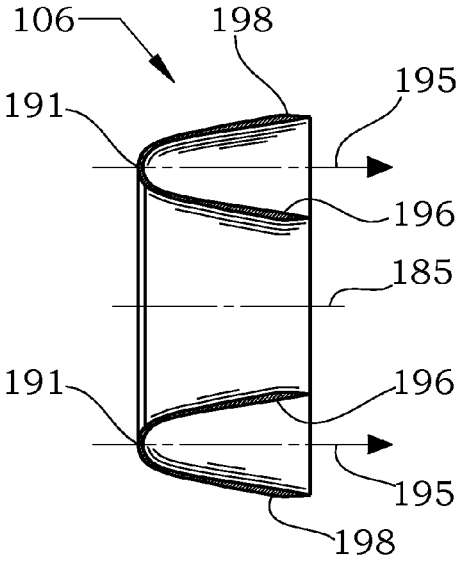
FIG. 1B is a cross-sectional view of a hollow forward folded explosively formed projectile (EFP) formed from a REFPff liner.

FIG. 1B is a cross-sectional view of a hollow double wall shuttlecock like projectile called a forward folding EFP 106 produced by a REFPff device. The forward folding EFP 106 consists of an outer wing 198, inner wing 196, apex 191, projection axis 195, and symmetrical axis 185. The inner wing 196 and outer wing 198 where folded and stretched in the direction of the projection axis 195 arrow and forward of apex 191 by the detonation of the HE hence the name forward folding EFP. The forward folding EFP 106 angle of projection, thickness, length and inside diameter can vary depending on the design of the REFPff device. The projection axis 195 is shown parallel to symmetrical axis 185 but could be almost any angle either converging or diverging depending on the REFPff device design and intended use.

Figure 2:
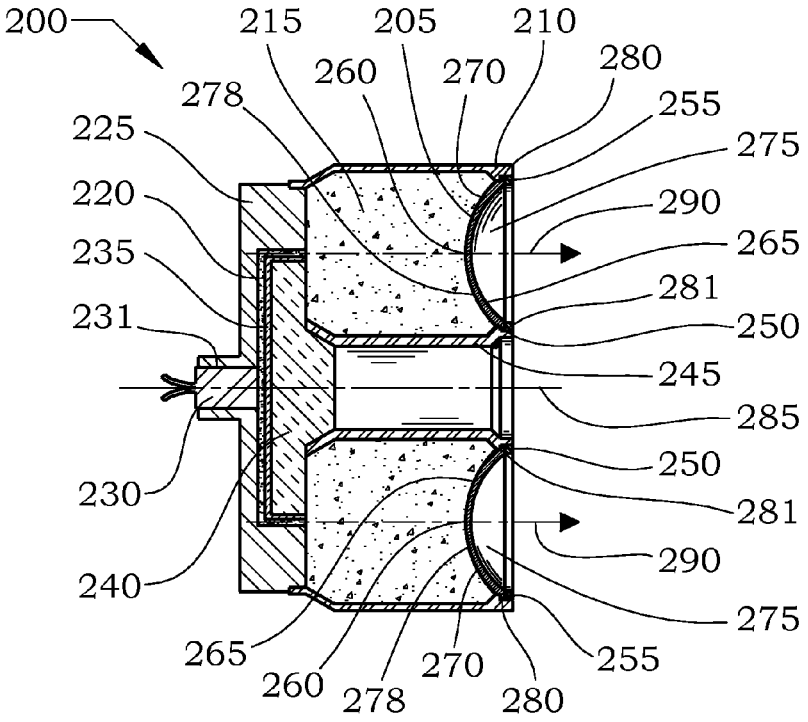
FIG. 2 is a cross-sectional view of a rearward facing revolved arc profile explosively formed projectile (REFPrf) shape charge device.

The revolved arc profile explosively formed projectile rearward folding (REFPrf) device 200 shown in FIG. 2 consists of a REFPrf liner 205, body 210, HE billet 215 which is a mass of high explosive, a Circular Precision Initiation Coupler (CPIC), an explosive shock attenuator (ESA) 240, center body 245, inner retaining ring 250, and outer retaining ring 255. All components of REFPrf 200 share a common symmetrical axis 285.

The REFPrf liner 205, located about the fore area of the REFPrf, is the working material of the shaped charge and will be optimized in thickness, profile and material to produce the desired effects on the target material. Preferably the liner uses a copper material, but liners may be made from most any metal, ceramic, powdered metals, tungsten, silver, copper or a combination thereof.

Figure 2A:
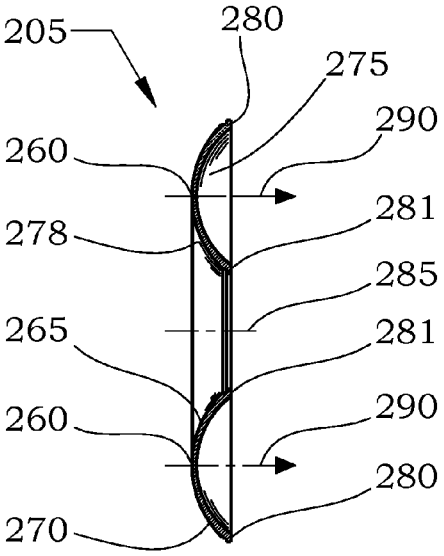
FIG. 2A is a cross-sectional view of REFPrf liner.

The REFPrf liner 205, as singularly shown in FIG. 2A, has an inside wall 265, an outside wall 270, a pole 260 an outer base end 280, an inner base end 281, an outer arc surface 278 that faces away from collapse axis 290, and an inner arc surface 275 that faces toward collapse axis 290. Outer arc surface 278 and inner arc surface 275 can be concentric to each other or offset centers to tailor the thickness of the inside wall 265 and outside wall 270. Stable jetting can be achieved if the REFPrf liner 205 wall mass on either side of the pole 260 at the collapse axis 290 is balanced correctly. The mass of the REFPrf liner 205 will increase greatly from the inside diameter (ID) closest to the symmetrical axis 285 to the outside diameter (OD) because of the large volume increase as the diameter of the liner wall increases from the ID to the OD. The mass difference must be compensated for to balance the momentum of the collapse and stretching of the REFPrf liner 205 walls and produce a stable projectile. This may be accomplished through experiment, computer code calculations, or calculations by other means.

The profile of a REFPrf liner is thin at the pole and thickening toward the inner and outer diameters. The diameter of the EFP formed from the REFPrf liner is greater than ⅔ the diameter of the device and will produce a hole greater than the overall diameter of the device, also known as super caliber hole.

Outer arc surface 278 and inner arc surface 275 can be concentric to each other or have offset centers to tailor the thickness of the inside wall 265 and outside wall 270, stable jetting can be achieved if the REFPrf liner 205 wall mass on either side of the pole 260 at the collapse axis 290 is balanced correctly. The mass of a constant wall thickness liner will increase greatly from the inside diameter (ID) closest to the symmetrical axis 285 to the outside diameter (OD) because of the large volume increase as the diameter of the liner wall increases from the ID to the OD. This can be solved by offsetting the centers of outer arc surface 278 to inner arc surface 275 making the inside wall 265 thicker than the outside wall 270 to achieve equal liner wall mass above and below the collapse axis 290.

Offset arc centers will make the thickness of inside wall 265 gradually decrease from the pole 260 to the inner base end 281, and the thickness of outside wall 270 gradually decreases from pole 260 to the outer base end 280. The wall thickness is varied in this way to balance the explosive charge to REFPrf liner 205 mass ratios, which also balances the momentum of the collapse and stretching of the REFPrf liner 205 walls. Liner wall momentum balancing will insure that inside wall 265 and outside wall 270 will stretch to approximately the same length forming and maintaining a stable EFP. Balancing the liner wall momentums should not be held only to the offset method previously described. Other thickness profiles of the liner can be utilized to balance liner wall momentums, i.e., multiple arcs making both the inside wall 265 and outside wall 270 could also be used to accomplish the desired profile thickness that will produce the best projectile performance.

For example, with a 5 inch diameter liner of offset arc centers, the inside wall 265 needs to be between 1-3 mm at the pole 260 and taper toward the inner base end 281 to between 2-5 mm. The outside wall 270 must taper the reverse direction from between 1.5-3 mm at the pole 260 and tapering down to between 1-2.5 mm at the outer base end 280. These dimensions will be refined with numerical code and experiment to give the most tailored jet to address the specific target material. Jet velocities can vary from 4 to 10 km/s depending on the liner material, wall thickness and other geometries. Other thickness profiles of the liner can be utilized to balance liner wall momentums (i.e., making both the inside wall 265 and outside wall 270 into multiple arcs to accomplish the desired profile thickness that will produce the best projectile performance).

The HE billet 215 provides the energy to collapse the REFPrf liner 205, causing it to form a hollow double wall rearward folded shuttlecock like projectile commonly called an explosively formed projectile EFP in the conventional world. The body 210 provides an outer mounting surface for REFPrf liner 205 which is held to body 210 by outer retaining ring 255. Body 210 also serves as a containment vessel to protect and hold the shape of the delicate HE billet 215 from damage or impact. Body 210 can provide tamping for HE billet 215 depending on body 210 thickness and material density.

The HE billet 215 in its most basic form is a right circular cylinder having a through hole at its center leaving a wall thickness, or distance from the inside diameter to the outside diameter of the HE billet, greater than the annulus width (AW) between the inside and outside diameters of the liner. The HE billet 215 is of sufficient length to provide adequate head height of HE aft of the liner outer semicircle surface 278 so there is sufficient HE to drive the liner 205 in the desired fashion. The fore end of the HE billet 215 has a concentric swept concavity matching the outer semicircle surface 278 of the liner, which is a convex surface, in size and contour. The thickness of the HE billet 215 being larger than the AW provides for super caliber explosive all the way to the equator of the half torus or circular hollow trough. This makes for higher jet velocities, more jet mass, longer jet and better penetration performance. The liner 205 is inserted snugly into the concavity of the HE billet 215, making a liner/HE subassembly of the device. The REFPrf device can use cast, pressed, extruded or even hand packed HE from any high quality explosive.

The wall thickness of the HE billet 215 can range from about 0-25% larger than the AW of the REFPrf liner 205 and still produce a proper jet. If the wall thickness of the liner and the amount of HE used are not correctly matched for the application it will result in an under driven or over driven liner, neither event will produce proper jetting. Adequate charge to mass ratios of HE to liner as per Gurney equations should be adhered to as close as the application size restrictions will allow to prevent underdriving or overdriving the liner.

The CPIC initiates detonation of the HE billet 215 in a circular pattern at the aft end and at the exact diameter of the pole of the REFPrf liner 205. The CPIC, located in the aft area of the REFPrf, consists of a CPIC HE 220, charge cover 225, detonator 230, and CPIC HE cover 235. Detonator 230, located about the aft of the CPIC, provides the initial detonation impulse to the shallow cup shaped CPIC HE 220. Charge cover 225 provides a mounting cavity 231 for detonator 230 and CPIC HE 220, and provides the critical alignment of detonator 230 with CPIC HE 220 on the symmetrical axis 285. Charge cover 225 also provides the critical alignment of CPIC HE 220 with HE billet 215, this alignment allows for a precise ring initiation of HE billet 215. Charge cover 225 also serves to cover and protect HE billet 215 and maintains intimate contact of CPIC HE 220 with the HE billet 215. The CPIC function is to transform a single point initiation from detonator 230 into a ring detonation of the CPIC HE 220 that will ring initiate the aft end of the HE billet 215 which is precisely aligned with the collapse axis 290 and pole of REFPrf liner 205.

To initiate a revolved profile EFP device the HE billet 215 detonation must be initiated in a simultaneous ring detonation from a Circular Precision Initiation Coupler (CPIC). The precision of the circular simultaneous initiation of the HE billet 215 is accomplished by the use of a novel Circular Precision Initiation Coupler (CPIC). The CPIC initiation system is a single point to ring or peripheral initiation and is mated to the aft end of the HE billet 215 and centered by the outer body 210 so as to align the CPIC output with the pole axis of the liner 205. As the detonation wave reaches the intersection of the collapse axis 290 and pole 260 of the liner 205, the enormous detonation pressures cause the pole material of the liner 205 to accelerate forward and the inner 265 and outer 270 walls to elongate along the collapse axis 290 forming the walls of the stretching hollow cylindrical jet. This CPIC uses a single point initiation to create a simultaneous peripheral detonation of the HE billet 215 that collapses and drives the REFPrf liner 205 into a high speed stretching hollow cylindrical projectile, or more commonly called a jet in the industry. The CPIC can be used with many swept liner geometries, and tailored to the desired size and shape required.

The REFPrf liner 205 looks like a length of thin walled tubing formed into a circle and cut parallel to the equatorial plane at less than a full diameter, forming a thin wall trough with a wall thickness between inner arc surface 275 and outer arc surface 278. The REFPrf liner 205 could also be described as a washer, having a shallow concavity with an inner and outer surface, forming concave and convex surfaces. The depth of the trough concavity is shallow and carefully controlled in thickness profile between the inner arc surface 275 and outer arc surface 278, providing for the desired stretch during the formation of the large diameter hollow cylindrical projectile. The inner arc surface 275 and outer arc surface 278 of the REFPrf liner 205 can be concentric to each other or offset from one another, non-concentric arcs can help compensate for an unbalanced stretch rate of the projectile and help balance the detonation gas pressure retention on the inner wall due to space restrictions. Circular is not the only shape possible with this revolved arc profile.

The revolved arc segments of the REFPrf liner 205 profile forms an inner concave arc and outer convex arc surface with a thickness profile between these surfaces. The convex surface of the liner is interfaced to a concave circular depression in the fore end of the HE billet, the HE billet having inner and outer diameters similar to the liner diameters. When the HE billet is initiated, a detonation wave travels through the HE from rear to front of the device releasing its energy and driving the REFP liner. As the detonation wave reaches the pole axis of the REFP liner it causes the pole material of the liner to accelerate forward and the inner and outer walls to elongate parallel to the collapse axis, forming the double wall of the hollow shuttlecock like projectile. When the HE billet is detonated on the aft end in a simultaneous ring, which is aligned with the liner pole axis, the ring detonation wave folds the liner, pole first for a REFPrf, into a double wall hollow cylindrical projectile of more than ⅔ the diameter of the device.

The jetting trajectory of this REFPrf liner 205 can be aimed other than parallel to the symmetrical axis of the device just by a changing the angle of attack of the detonation wave relative to the pole axis of the liner 205. This is done by changing the diameter and angle of the CPIC initiation of the HE billet 215 so the detonation front engages the liner outer semicircle surface 278 at either a larger or smaller diameter than the collapse axis 290 and tangentially to the liner curvature.

To produce a straight EFP jet about the symmetrical axis 285 of the REFPrf device, it is necessary to balance the explosive gas pressures and the inner 265 and outer 270 liner wall masses. The liner wall masses can be balanced by adjusting the wall thickness on either side of the pole 260 at the collapse axis 290 of the liner 205, these liner wall masses differ due to large volume increase as the diameter of the liner wall increases. The HE mass also increases greatly with a diameter increase and needs to be balance correctly to the given liner mass. Adequate charge to mass ratios of explosive to liner as per Gurney equations should be adhered to as close as the application size restrictions will allow to prevent underdriving or overdriving the liner. The ideal charge to mass ratio can be tricky to obtain for a REFPrf liner device especially as the device becomes smaller (i.e., a 5 inch REFPrf liner device has more space or volume between the symmetrical axis and the collapse axis for HE mass balancing than a 2 inch REFPrf).

The ESA 240 is a shock attenuator made from a low sound velocity material and serves as a detonation wave dampener. Center body 245 supports the inner diameter of HE billet 215, provides space for ESA 240, a path for escaping detonation gases, and other devices (i.e., secondary projectile forming devices). Center body 245 provides an inner mounting surface for REFPrf liner 205 and aligns it with symmetrical axis 285. Forward folding REFP liner 205 is held to center body 245 by inner retaining ring 250. REFPrf device 200 is capable of producing a double wall rearward folded shuttlecock like projectile from the REFPrf liner 205 that will produce a full caliber hole in the target.

The center body 245 is encompassed by the explosive charge or main high explosive (HE) billet and can be solid or hollow. The hollow center body 245, being an essential part of the revolved design, could contain shock attenuation materials used to dampen, reflect, and absorb shock waves that would have a detrimental effect on the formation of a stable jet. The hollow center body 245 space can also be used to contain a center projectile producing device or for adjusting HE billet quantity driving the inside wall of the liner, in addition the space can be used to relieve pressure from expanding gasses from the detonation of the HE.

Detonation shock wave control is very important to form stable jetting from shaped charges. Reflected shock waves can negatively affect jet formation and the overall performance of the shape charge. The REFPrf liner 205 design in this embodiment has various features incorporating irregular shaped solids, in the hollow center body 245. These shaped solids can be made from low sound speed material such as high density foam, powdered metals and combinations thereof. Since the smaller REFPrf devices offer little room in the center body 245, measures must be taken to break up, absorb and attenuate the shock from HE detonation in this region for sufficient time for the jet to form.

In order to take advantage of the penetrating power of a shaped charge to produce a full caliber hole, it is necessary to concentrate the energy of the jetting material in a different pattern than that of a conventional shaped charge, such as spreading the energy into a large diameter circle, thus the need for a revolved double arc segment profile design. Technical definitions for these shapes are difficult to create, in this interest an explanation of segment is in order.

A segment of a circle is the area bounded by the arc and a chord, the chord being less than a full circles diameter. In the case of the revolved profile liner, there must be two arcs and we are only concerned with the area between these arcs, which forms the thickness profile that is revolved about the axis of symmetry forming a shallow concave trough with an inside and outside diameter.

This shallow profile circular trough has a pole axis which divides the REFPrf liner into an outside wall and inside wall, the inside wall having less mass than the outside wall for the same thickness due to smaller diameter and less volume. The mass difference must be compensated for to produce a stable projectile, this will be accomplished through experiment and computer code calculations.

The HE billet inner and outer thickness and mass will also need to be compensated for because of the volume changes due to diameter. This inner and outer HE to liner mass balance will be done by tailoring the inner and outer HE billet thickness to provide the right impulse to the liner walls on both sides of the pole or collapse axis.

To produce a straight axisymmetric hollow cylindrical jet about the symmetrical axis of the REFP device it is necessary to balance the explosive gas pressures and the wall thickness on either side of the pole or collapse axis of the REFPrf liner. The inner and outer walls separated by the collapse axis have different masses due to diameter differences and longer duration pressures in the center due to space restrictions especially in smaller diameters.

FIG. 2A shows the REFPrf liner 205 that is used in device 200 of FIG. 2. The REFPrf liner 205 consist of a outer base end 280, inner wall 265, pole 260, inner base end 281, outer wall 270, axis of symmetry 285, collapse axis 290, an inner arc surface 275 and outer arc surface 278. Collapse axis 290 is shown parallel to the axis of symmetry 285, but can be almost any angle relative to the axis of symmetry 285 that would represent a converging or diverging projectile trajectory formed by the detonation wave and REFPrf liner 205. The REFPrf liner 205 is a thin walled arc profile, swept or revolved about a central symmetrical axis 285. The swept profile having an inside and outside diameter, a radius depth to inner arc surface 275 and outer arc surface 278 along the collapse axis 290, and when revolved about its symmetrical axis 285 it forms a hollow circular trough with an arced concavity between the inner and outer diameters. There is a wall thickness to this trough that is proportional to the outside diameter minus the inside diameter of the liner.

Outer arc surface 278 and inner arc surface 275 can be concentric to each other or have offset centers to tailor the thickness of the inner wall 265 and outer wall 270, stable jetting can be achieved if the REFPrf liner 205 wall mass on either side of the pole 260 at the collapse axis 290 is balanced correctly. The mass of a constant wall thickness Liner will increase greatly from the inside diameter (ID) closest to the symmetrical axis 285 to the outside diameter (OD) because of the large volume increase as the diameter of the liner wall increases from the ID to the OD. This can be solved by offsetting the centers of outer arc surface 278 to inner arc surface 275 making the inner wall 265 thicker than the outer wall 270 to achieve equal liner wall mass above and below the collapse axis 290.

Offset arc centers will make the thickness of inner wall 265 gradually increases from the pole 260 to the inner base end 281, and the thickness of outer wall 270 gradually increase from pole 260 to the outer base end 280. The wall thickness is varied in this way to balance the explosive charge to REFPrf liner 205 mass ratios, which also balances the momentum of the collapse and stretching of the REFPrf liner 205 walls. Liner wall momentum balancing will insure that inner wall 265 and outer wall 270 will stretch to approximately the same length forming and maintaining a stable EFP. Balancing the liner wall momentums should not be held only to the offset method previously described. Other thickness profiles of the liner can be utilized to balance liner wall momentums, i.e., multiple arcs making both the inside wall 265 and outside wall 270 could also be used to accomplish the desired profile thickness that will produce the best projectile performance.

Figure 2B:
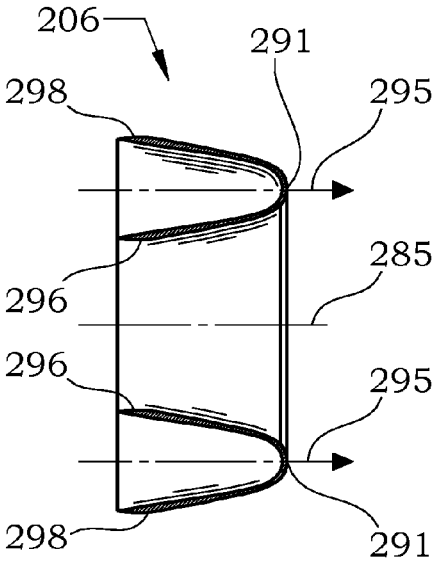
FIG. 2B is a cross-sectional view of a hollow rearward folded explosively formed projectile (EFP) formed from a REFPrf liner.

FIG. 2B is a cross-sectional view of a hollow double wall shuttlecock like projectile called an rearward folding EFP 206 produced by a REFPrf device. The rearward folding EFP 206 consists of a outer wing 298, inner wing 296, apex 291, projection axis 295, and symmetrical axis 285. The inner wing 296 and outer wing 298 where folded and stretched in the direction of the projection axis 295 arrow and forward of apex 291 by the detonation of the HE hence the name rearward folding EFP. The rearward folding EFP 206 angle of projection, thickness, length and inside diameter can vary depending on the design of the REFPrf device. The Projection axis 295 is shown parallel to symmetrical axis 285 but could be almost any angle either converging or diverging depending on the REFPrf device design and intended use.

The invention claimed is:

1. An explosively formed projectile shaped charge device, comprising:

a liner configured in a partial toroid with a longitudinal axis intersecting an aperture located near the center of said partial toroid, said partial toroid being open-ended on a plane that intersects said longitudinal axis in a perpendicular manner toward a front end of the shaped charge device, said liner having a hollow arc cross-section extending toward a closed end of the partial toroid as defined by a longitudinal plane that is aligned on said longitudinal axis and a pole of said arc cross-section at a closed end of the partial toroid that extends toward a rear end of said shaped charge device, said liner having an outer surface and an inner surface, said inner surface exposed toward the open end of the front end of the shaped charge device, said liner having a smaller thickness proximate the open end of said partial toroid and a larger thickness proximate the pole at the closed end of said partial toroid, said liner producing a pole trailing explosive large diameter double wall hollow cylindrical explosively formed projectile directed toward said front of said shaped charge device upon detonation of the shaped charge device;

a billet of high explosive material having a front end and a rear end located behind and proximate to the outer surface of said liner, said billet configured as a toroid with an internal aperture located proximate to the aperture of the liner, and said billet producing a high explosive detonation effect applied to said liner to produce said large diameter double wall hollow cylindrical explosively formed projectile;

a coupler located in a rear portion of the shaped charge device, said coupler coupled to the rear end of the billet and said coupler producing a detonation wave initiating the high explosive detonation effect of the billet; and a body located around the outer surface of the billet and extending longitudinally the length of the billet, said body having a front end secured to said liner and, said body having a rear end secured to the coupler.

2. The shaped charge of claim 1, wherein the coupler initiates a high explosive detonation effect on the billet to direct the trajectory of said large diameter double wall hollow cylindrical explosively formed projectile toward the longitudinal axis of the shaped charge device.

3. The shaped charge of claim 1, further comprising:

an attenuator located proximate to the aperture in the billet, said attenuator dampening a detonation wave.

4. The shaped charge of claim 1, wherein said coupler initiates a ring initiation at the rear end of the billet to produce the detonation wave and initiate the high explosive detonation effect of the billet.

5. The shaped charge of claim 1, wherein the coupler provides the critical alignment of the detonator with the coupler high explosive on the longitudinal axis of the shaped charge and provides the critical alignment of the coupler high explosive with the billet which to allow for a precise ring initiation of the billet.

6. The shaped charge of claim 1, further comprising:

a center body located proximate to the aperture of said liner and rearward of the billet toward the rear portion of the shaped charge device.

7. The shaped charge of claim 6, wherein the center body is hollow and provides a space for shock attenuation materials used to dampen shock waves.

8. The shaped charge of claim 7, wherein the space within the hollow center body can be used to contain a center projectile producing device.

9. The shaped charge of claim 1, wherein the large diameter double wall hollow cylindrical explosively formed projectile is greater than ⅔ the diameter of the shaped charge device and will produce a hole greater than the overall diameter of the shaped charge device.

10. The shaped charge of claim 1, wherein the large diameter double wall hollow cylindrical explosively formed projectile forms a hole in a target material that is wider than the outer diameter of the shaped charge device.

11. An explosively formed projectile shaped charge device, comprising:

a liner configured in a partial toroid with a longitudinal axis intersecting an aperture located near the center of said partial toroid, said partial toroid being open-ended on a plane that intersects said longitudinal axis in a perpendicular manner toward a front end of the shaped charge device, said liner having a hollow arc cross-section extending toward a closed end of the partial toroid as defined by a longitudinal plane that is aligned on said longitudinal axis and a pole of said arc cross-section at a closed end of the partial toroid that extends toward a rear end of said shaped charge device, said liner having an outer surface and an inner surface, said inner surface exposed toward the open end of the front end of the shaped charge device, said liner having a larger thickness proximate the open end of said partial toroid and a smaller thickness proximate the pole at the closed end of said partial toroid, said liner producing a pole leading explosive large diameter double wall hollow cylindrical explosively formed projectile directed toward said front of said shaped charge device upon detonation of the shaped charge device;

a billet of high explosive material having a front end and a rear end located behind and proximate to the outer surface of said liner, said billet configured as a toroid with an internal aperture located proximate to the aperture of the liner, and said billet producing a high explosive detonation effect applied to said liner to produce said large diameter double wall hollow cylindrical explosively formed projectile;

a coupler located in a rear portion of the shaped charge device, said coupler coupled to the rear end of the billet and said coupler producing a detonation wave initiating the high explosive detonation effect of the billet; and a body located around the outer surface of the billet and extending longitudinally the length of the billet, said body having a front end secured to said liner and, said body having a rear end secured to the coupler.

12. The shaped charge of claim 11, wherein the coupler initiates a high explosive detonation effect on the billet to direct the trajectory of said large diameter double wall hollow cylindrical explosively formed projectile toward the longitudinal axis of the shaped charge device.

13. The shaped charge of claim 11, further comprising:

an attenuator located proximate to the aperture in the billet, said attenuator dampening a detonation wave.

14. The shaped charge of claim 11, wherein said coupler initiates a ring initiation at the rear end of the billet to produce the detonation wave and initiate the high explosive detonation effect of the billet.

15. The shaped charge of claim 11, wherein the coupler provides the critical alignment of the detonator with the coupler high explosive on the longitudinal axis of the shaped charge and provides the critical alignment of the coupler high explosive with the billet which to allow for a precise ring initiation of the billet.

16. The shaped charge of claim 11, further comprising:

a center body located proximate to the aperture of said liner and rearward of the billet toward the rear portion of the shaped charge device.

17. The shaped charge of claim 16, wherein the center body is hollow and provides a space for shock attenuation materials used to dampen shock waves.

18. The shaped charge of claim 17, wherein the space within the hollow center body can be used to contain a center projectile producing device.

19. The shaped charge of claim 11, wherein the large diameter double wall hollow cylindrical explosively formed projectile is greater than ⅔ the diameter of the shaped charge device and will produce a hole greater than the overall diameter of the shaped charge device.

20. The shaped charge of claim 11, wherein the large diameter double wall hollow cylindrical explosively formed projectile forms a hole in a target material that is wider than the outer diameter of the shaped charge device.

21. A method of producing a double wall hollow cylindrical explosively formed projectile from a shaped charge device, comprising the steps of:

providing a liner configured in a partial toroid with a longitudinal axis intersecting an aperture located near the center of said partial toroid, said partial toroid being open-ended on a plane that intersects said longitudinal axis in a perpendicular manner toward a front end of the shaped charge device, said liner having a hollow hemispherical cross-section extending toward a closed end of the partial toroid as defined by a longitudinal plane that is aligned on said longitudinal axis and a pole of said hemispherical cross-section at a closed end of the partial toroid that extends toward a rear end of said shaped charge device, said liner having an outer surface and an inner surface, said inner surface exposed toward the open end of the front end of the shaped charge device, said liner having a first thickness proximate the open end of said partial toroid and a second thickness proximate the pole at the closed end of said partial toroid;

said liner producing a pole leading or trailing explosive large diameter double wall hollow cylindrical explosively formed projectile directed toward said front of said shaped charge device upon detonation of the shaped charge device;

positioning a billet of high explosive material behind and proximate to the outer surface of said liner, said billet being proximate to the aperture of the liner, and said billet producing a high explosive detonation effect applied to said liner;

positioning a coupler at a rear portion of the shaped charge device in contact with the rear of the billet, said coupler producing a detonation wave and initiating the high explosive detonation effect of the billet;

surrounding the shaped charge device with a body around the outer diameter of the billet and extending longitudinally the length of the billet; and producing a large diameter double wall hollow cylindrical explosively formed projectile with the liner that is directed toward said front of said shaped charge device upon detonation of the shaped charge device.

22. The method of claim 21, wherein the coupler initiates a high explosive detonation effect on the billet to direct the trajectory of said large diameter double wall hollow cylindrical explosively formed projectile toward the longitudinal axis of the shaped charge device.

23. The method of claim 21, further comprising the step of: providing an attenuator proximate to the aperture in the billet, said attenuator dampening a detonation wave.

24. The method of claim 21, wherein said coupler initiates a ring initiation at the rear end of the billet to produce the detonation wave and initiate the high explosive detonation effect of the billet.

25. The method of claim 21, wherein the coupler provides the critical alignment of the detonator with the coupler high explosive on the longitudinal axis of the shaped charge and provides the critical alignment of the coupler high explosive with the billet which to allow for a precise ring initiation of the billet.

26. The method of claim 21, further comprising the step of: positioning a center body proximate to the aperture of said liner and rearward of the billet toward the rear portion of the shaped charge device.

27. The method of claim 26, wherein the center body is hollow and provides a space for shock attenuation materials used to dampen shock waves.

28. The method of claim 27, wherein the space within the hollow center body can be used to contain a center projectile producing device.

29. The method of claim 21, wherein the large diameter double wall hollow cylindrical explosively formed projectile is greater than ⅔ the diameter of the shaped charge device and will produce a hole greater than the overall diameter of the shaped charge device.

30. The method of claim 21, wherein the large diameter double wall hollow cylindrical explosively formed projectile forms a hole in a target material that is wider than the outer diameter of the shaped charge device.

* * * * *